US009586788B2

(12) United States Patent
Soto

(10) Patent No.: US 9,586,788 B2
(45) Date of Patent: Mar. 7, 2017

(54) REEL SYSTEM

(71) Applicant: David Soto, Santa Clarita, CA (US)

(72) Inventor: David Soto, Santa Clarita, CA (US)

(73) Assignee: David Soto, Santa Clarita, CA (US)

( * ) Notice: Subject to any disclaimer, the term of this patent is extended or adjusted under 35 U.S.C. 154(b) by 200 days.

(21) Appl. No.: 13/924,563

(22) Filed: Jun. 22, 2013

(65) Prior Publication Data

US 2015/0166300 A1 Jun. 18, 2015

Related U.S. Application Data

(60) Provisional application No. 61/690,284, filed on Jun. 25, 2012.

(51) Int. Cl.

| | |
|---|---|
| ***B65H 75/34*** | (2006.01) |
| ***B65H 75/44*** | (2006.01) |
| ***B65H 75/14*** | (2006.01) |
| ***B65H 75/28*** | (2006.01) |

(52) U.S. Cl.

CPC ..... *B65H 75/4494* (2013.01); *B65H 75/14* (2013.01); *B65H 75/28* (2013.01); *B65H 2402/412* (2013.01); *B65H 2701/33* (2013.01)

(58) Field of Classification Search

CPC ..... B65H 75/00; B65H 75/02; B65H 75/14; B65H 75/141; B65H 75/16; B65H 75/22; B65H 81/02; B65H 2301/42254; B65H 2301/4494

See application file for complete search history.

(56) References Cited

U.S. PATENT DOCUMENTS

| | | | | |
|---|---|---|---|---|
| 2,801,303 | A * | 7/1957 | Pailing | A47L 9/26 191/12.4 |
| 3,313,498 | A * | 4/1967 | Wasson | B65H 49/205 242/395.1 |
| 3,880,378 | A | 4/1975 | Ballenger | |
| 4,244,536 | A * | 1/1981 | Harrill | B65H 75/40 191/12.2 R |
| 4,451,014 | A * | 5/1984 | Kitt | B65H 49/02 242/128 |
| 4,557,430 | A * | 12/1985 | Bonhard | B65H 75/4471 191/12.2 R |
| 4,984,685 | A * | 1/1991 | Douglas | B65H 75/362 206/388 |
| D314,910 | S * | 2/1991 | VanSkiver | D8/358 |
| 5,103,977 | A * | 4/1992 | Douglas | B65H 75/364 206/388 |

(Continued)

*Primary Examiner* — Christopher Harmon
(74) *Attorney, Agent, or Firm* — Bay Area IP

(57) ABSTRACT

A reel system includes a hinged crank handle portion that turns a frame portion on an axis for winding and unwinding a coilable portion. The handle portion folds into the frame inner area, forming a flat surface on the flange, to allow for facilitated storage of a plurality of reel systems in a five gallon bucket. A frame portion rotates on an axis for winding and unwinding a coilable portion. The frame portion includes a frame outer area for engaging the coilable portion. The frame portion further includes a frame inner area for receiving and securing a terminal portion of the coilable portion. The terminal portion passes from the frame outer area to the frame inner area through a central aperture. A rod extends across the diameter of the frame inner area, forming a surface to grip the reel system.

18 Claims, 11 Drawing Sheets

(56) References Cited

U.S. PATENT DOCUMENTS

| | | | | | |
|---|---|---|---|---|---|
| D341,770 | S | * | 11/1993 | Spear | D8/359 |
| D359,440 | S | * | 6/1995 | Stewart | D8/358 |
| 5,425,391 | A | | 6/1995 | Tisbo et al. | |
| 5,848,701 | A | * | 12/1998 | Riccabona | B25H 3/00 206/373 |
| D408,720 | S | * | 4/1999 | Sheng | D8/359 |
| 5,915,641 | A | * | 6/1999 | Barberg | B65H 75/40 191/12.2 R |
| 6,056,226 | A | * | 5/2000 | Green | H02G 11/02 191/12.2 R |
| 6,186,433 | B1 | * | 2/2001 | Kovacik | B65H 75/40 191/12.2 A |
| 6,199,786 | B1 | | 3/2001 | Lessard et al. | |
| 6,834,670 | B2 | | 12/2004 | Rosine et al. | |
| 6,908,058 | B2 | | 6/2005 | Moon et al. | |
| 7,293,734 | B1 | * | 11/2007 | Kantner | B65H 75/305 242/395.1 |
| D557,119 | S | * | 12/2007 | Laga | D8/359 |
| 7,438,258 | B2 | | 10/2008 | Chen | |
| 7,575,188 | B2 | | 8/2009 | Mullen et al. | |
| 8,074,916 | B2 | | 12/2011 | Penumatcha et al. | |
| 8,366,126 | B2 | | 2/2013 | Galgano et al. | |
| 9,248,952 | B2 | * | 2/2016 | Burrous | B65D 85/04 |
| 2002/0096592 | A1 | | 7/2002 | Chuang | |
| 2008/0283649 | A1 | | 11/2008 | Anger et al. | |

* cited by examiner

REEL SYSTEM

CROSS-REFERENCE TO RELATED APPLICATIONS

The present Utility patent application claims priority benefit of the [U.S. provisional application for patent Ser. No. 61/690,284, entitled "Buckreel", filed on 25 Jun. 2012 under 35 U.S.C. 119(e). The contents of this related provisional application are incorporated herein by reference for all purposes to the extent that such subject matter is not inconsistent herewith or limiting hereof.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to reels. More particularly, the invention relates to a reel with a handle that folds into the reel to facilitate stacking of a plurality of wheels.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that long coilable objects, such as hoses, cables, and Christmas tree lights must be coiled for storage. Unfortunately, the weather elements, rodents, and other tools may damage the coilable objects.

Typically, a reel is an object around which lengths of a coilable material are wound for storage. Generally a reel has a cylindrical core and walls on the sides to retain the material wound around the core. In some cases the core is hollow, although other items may be mounted on it, and grips may exist for mechanically turning the reel.

In many cases, a hinge is a type of bearing that connects two solid objects, typically allowing only a limited angle of rotation between them. Two objects connected by an ideal hinge rotate relative to each other about a fixed axis of rotation. Hinges may be made of flexible material or of moving components.

Often, a flange is an external or internal ridge, or rim, for strength, as the flange of an iron beam such as an I-beam or a T-beam. The flange may also be used for attachment to another object.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2A illustrates an exemplary handle portion extending from an exemplary flange for operation, and FIG. 2B illustrates an exemplary handle portion folded into an exemplary frame inner area for storage, in accordance with an embodiment of the present invention;

FIG. 4A illustrates an exemplary grip rod secured to an exemplary grip end with a handle fastener, FIG. 4B illustrates a top view of a handle base, FIG. 4C illustrates an top view of an exemplary handle fastener, FIG. 4D illustrates an top view of an exemplary handle fastener, FIG. 4E illustrates a detailed perspective view of an exemplary handle fastener, and FIG. 4F illustrates a side view of an exemplary handle fastener, in accordance with an embodiment of the present invention; FIG. 5A illustrates an exemplary detailed perspective view of an exemplary support rod frame with at least one support rod flange, FIG. 5B illustrates an exemplary detailed perspective view of an exemplary support rod frame with at least one support rod flange, FIG. 5C illustrates an exemplary side view of an exemplary support rod frame with at least one support rod flange, FIG. 5D illustrates an exemplary top view of an exemplary support rod frame with at least one support rod flange, FIG. 5E illustrates an exemplary side view of an exemplary support rod frame with at least one support rod flange, FIG. 5F illustrates an exemplary top view of an exemplary support rod frame with at least one support rod flange, FIG. 5G illustrates an exemplary side view of an exemplary support rod frame with at least one support rod flange, and FIG. 5H illustrates an exemplary side view of an exemplary support rod frame with at least one support rod flange, in accordance with an embodiment of the present invention.

Figure 1:
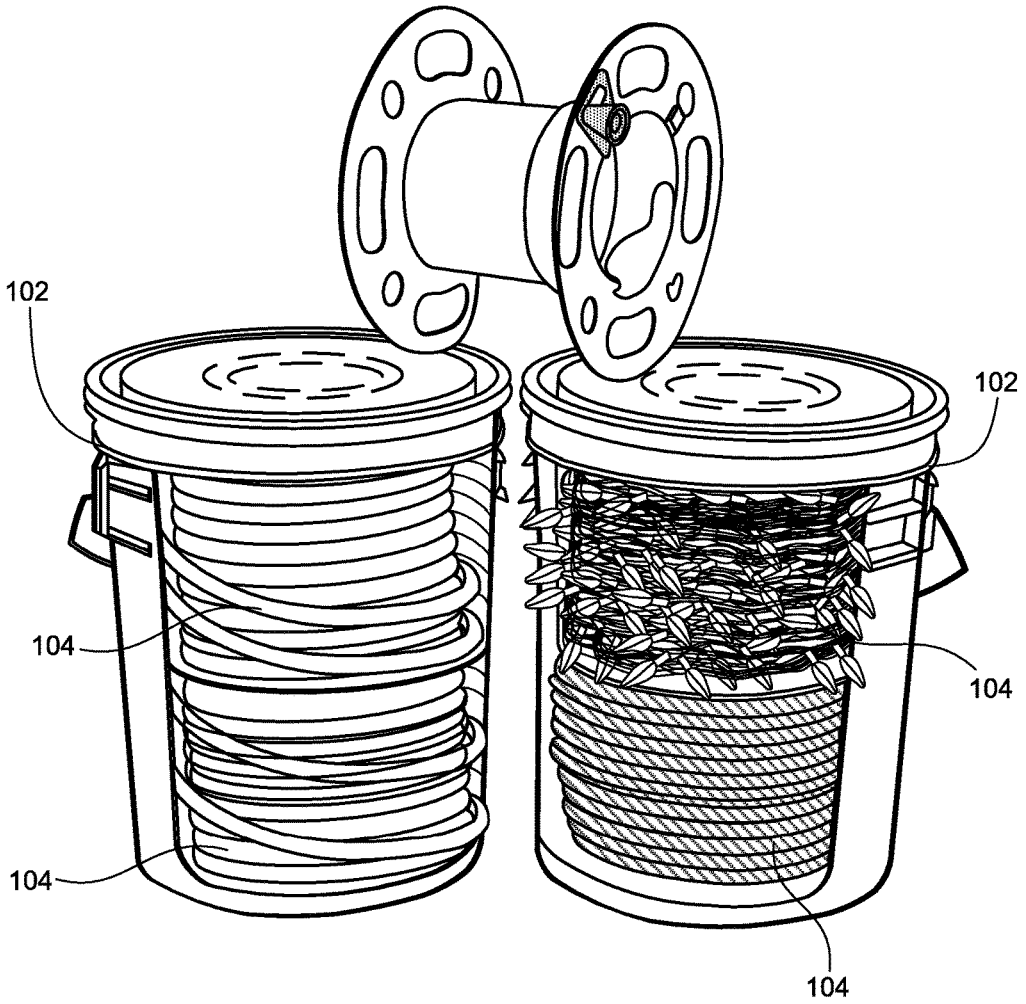
FIG. 1 illustrates a detailed perspective view of an exemplary reel system stacked in an exemplary container, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, systems, and materials are described, although any methods, techniques, systems, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Systems or system modules that are in at least general communication with each other need not be in continuous communication with each other, unless expressly specified otherwise. In addition, systems or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

The present invention will now be described in detail with reference to embodiments thereof as illustrated in the accompanying drawings.

There are various types of reel systems that may be provided by preferred embodiments of the present invention. In one embodiment of the present invention, the reel system may include a hinged crank handle that turns a reel on an axis for winding and unwinding a coilable portion. The handle portion may also fold into the frame inner area, forming a flat surface on the flange to allow for facilitated storage of the reel in a container, such as a five gallon bucket. In some embodiments, the reel system may include a frame portion configured to rotate on an axis for winding and unwinding a coilable portion. The frame portion may be operable to rotate around a handle portion that controls the direction of rotation. In one embodiment, the frame portion may be sized and dimensioned to fit inside a container, including, without limitation, a five gallon bucket and a three gallon bucket. In some embodiments, the frame portion may include a frame outer area for engaging the coilable portion. The frame portion may further include a frame inner area for receiving and securing a terminal portion of the coilable portion. The terminal portion may at least partially pass from the outer area to the inner area through a central aperture. The central aperture may provide a sufficiently sized gap for the coiled portion to pass through. The central aperture may also secure the coilable portion in place while winding and/or unwinding the coilable portion. In some embodiments, a support rod frame may position inside the frame portion. At least one support rod flange positioned on both sides of the support rod frame helps secure the support rod frame to the frame portion. The support rod frame may include a support rod that extends across the diameter of the inner area, forming a surface to grip, handle, and maneuver the reel system. The support rod frame may rotate freely within the frame inner area.

In one embodiment of the present invention, a pair of flanges position on each open end of the frame portion, orienting perpendicularly to the frame portion. The pair of flanges may be efficacious for forming a boundary to retain the coilable portion on the outer area. The pair of flanges may also elevate the coilable portion off the ground surface. Each flange may include a plurality of slots for accommodating the terminal portion while the reel system is in storage or stacked. In some embodiments, each flange may include a plurality of handle apertures. A plurality of hinges may position adjacent to the plurality of handle apertures. In some embodiments, at least one of the flanges may include a depression that extends from the periphery of the flange. The depression may be configured to allow an excess length of the coilable portion to fold into the frame portion inner area. The depression may also provide a space for the terminal portion to fold into so that the pair of flanges may have a flat surface for stacking a plurality of reel systems. In one embodiment, the central aperture may help retain the coilable portion in place. The depression may allow larger coilable portions to secure in a central area of the frame portion when the coilable portion is wound. Those skilled in the art, in light of the present teachings, will recognize that large cord ends may prevent the reel system from fitting in the bucket due to the cord being too bulky to fit between the wound reel system and the bucket inside surface.

In one embodiment of the present invention, a handle portion may extend from one of the flanges to provide a grip for rotating the frame portion such that the coilable portion winds and unwinds. In this manner, cranking the handle portion in a first direction winds the coilable portion into the frame portion, and cranking the handle portion in a second direction unwinds the coilable portion out of the frame portion. In some embodiments, the handle portion includes a handle base that sets flush against the flange. The handle base includes a hinged end for pivoting the handle portion. The hinged end includes a hinge notch configured to join with the hinge portion on the flange. The handle base further includes a grip end for controlling the handle portion. The grip end includes a grip rod that extends out from the flange for gripping and controlling the handle portion. A handle fastener may extend from an opposite direction of the grip end, passing through the handle aperture to secure the grip end to the flange. In this manner, the base may be secured on one end, and hingedly joined on the other end. In some embodiments, the handle fastener may detach from the handle aperture, whereby the handle portion folds over, and into the inner area of the frame portion. In this manner, the flange may form a flat surface, efficacious for stacking a plurality of reel systems on top of each other. Conversely, the handle portion may pivot back from the inner area, out onto the flange to join the handle fastener with the handle aperture for winding and unwinding operations.

FIG. 1 illustrates a detailed perspective view of an exemplary reel system stacked in an exemplary container, in accordance with an embodiment of the present invention. In the present embodiment, a reel system 100 winds and unwinds a coilable portion with a handle portion that folds into a frame inner area to facilitate stacking of a plurality of reel systems. The reel system may include a hinged crank handle that turns a reel on an axis for winding and unwinding a coilable portion 104. The coilable portion may include, without limitation, a cable, a hose, Christmas tree lights, rope, an air hose, and a high pressure hose. The handle portion may also fold into the frame inner area, forming a flat surface on the flange to allow for facilitated storage of the reel in a container 102, such as a five gallon bucket. Those skilled in the art, in light of the present teachings, will recognize that the coilable portion may be damaged by rodents, elements, and damage from other tools. Thereby necessitating storage of the reel system with the coiled portion in sealed containers, such as plastic buckets. Suitable materials or fabricating the reel system may include, without limitation, high density polyethylene, rigid polymers, metal, wood, and fiberglass.

Figure 2A:
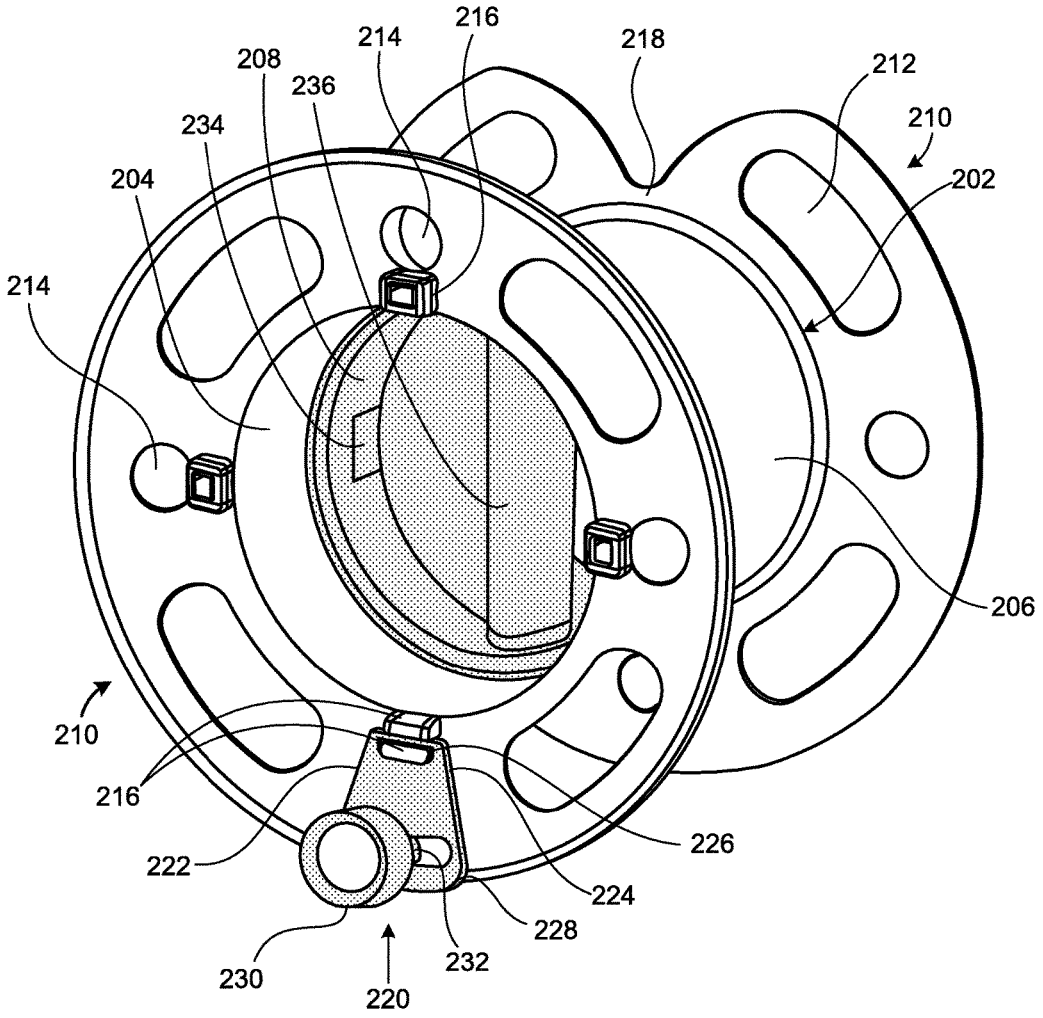
FIGS. 2A and 2B illustrate detailed perspective views of exemplary reel systems, where
Figure 2B:
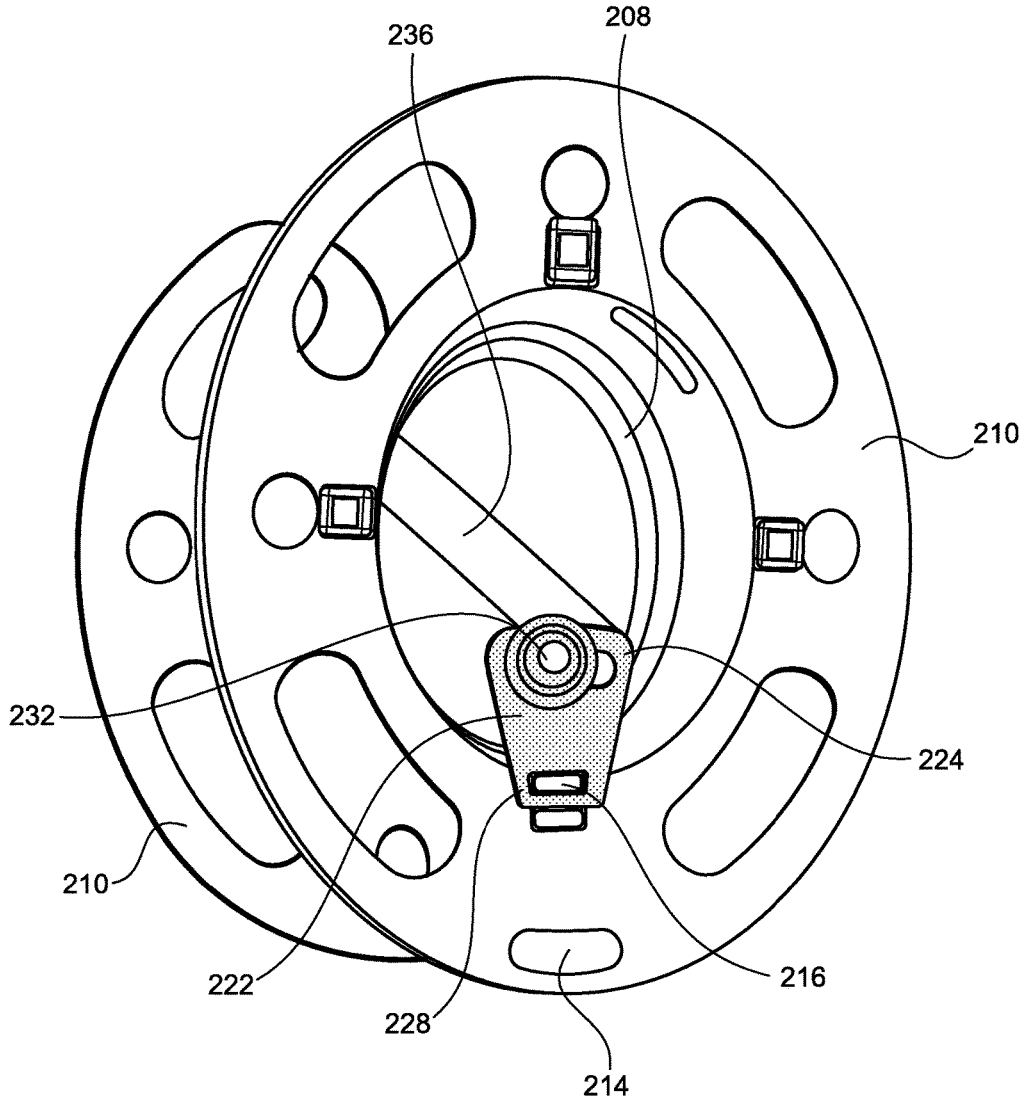

FIGS. 2A and 2B illustrate detailed perspective views of exemplary reel systems, where FIG. 2A illustrates an exemplary handle portion extending from an exemplary flange for operation, and FIG. 2B illustrates an exemplary handle portion folded into an exemplary frame inner area for storage, in accordance with an embodiment of the present invention. In the present embodiment, the reel system may include a frame portion 202 configured to rotate on an axis for winding and unwinding a coilable portion. In one embodiment, the frame portion may be automated, whereby a power source powers the winding and unwinding of the coilable portion. The frame portion may be operable to rotate around a handle portion that controls the direction of rotation. In one embodiment, the frame portion may be sized and dimensioned to fit inside a container, including, without limitation, a five gallon bucket. In some embodiments, the frame portion may include a frame outer area 206 for engaging the coilable portion. The frame outer area provides a surface area for the coilable portion to wind onto. The frame portion may further include a frame inner area 204 for receiving and securing a terminal portion of the coilable portion. The terminal portion may at least partially pass from the frame outer area to the frame inner area through a central aperture. The central aperture may provide a sufficiently sized gap for the coiled portion to pass through. The central aperture may also secure the coilable portion in place while winding and/or unwinding the coilable portion. In some embodiments, a support rod frame 208 may position inside the frame portion. At least one support rod flange 234 positioned on both sides of the support rod frame helps secure the support rod frame to the frame portion. The support rod frame may include a support rod 236 that extends across the diameter of the inner area, forming a surface to grip, handle, and maneuver the reel system. The support rod frame may rotate freely within the frame inner area. The terminal portion may wrap around the support rod, forming a secure connection.

In one embodiment of the present invention, a pair of flanges 210 position on each open end of the frame portion, orienting perpendicularly to the frame portion. The flanges provide numerous functions, including, without limitation, holding the coilable portion, raising the coilable portion of the ground surface. The pair of flanges may be efficacious for forming a boundary to retain the coilable portion on the frame outer area. Each flange may include a plurality of slots 212 and a plurality of handle apertures 214 configured to save material and reduce weight by forming a void. A plurality of hinges 216 may position adjacent to the plurality of handle apertures. The hinges that join to the plurality of handle apertures are similarly sized to maintain an even level for stacking. The plurality of hinges may position in proximity to the hub, rather than the perimeter of the frame portion. In some embodiments, at least one of the flanges may include a depression 218 that extends from the periphery of the flange. The depression may be configured to allow an excess length of the coilable portion to fold into the frame portion inner area. However, in some embodiments, the depression may be used to secure larger coilable portions. The depression may also provide a space for the terminal portion to fold into so that the pair of flanges may have a flat surface for stacking a plurality of reel systems.

In one embodiment of the present invention, a handle portion 220 may extend from one of the flanges to provide a grip for rotating the frame portion such that the coilable portion winds and unwinds. In this manner, cranking the handle portion in a first direction winds the coilable portion into the frame portion, and cranking the handle portion in a second direction unwinds the coilable portion out of the frame portion. In some embodiments, the handle portion includes a handle base 222 that sets flush against the flange. The handle base includes a hinged end 224 for pivoting the handle portion. The hinged end includes a hinge notch 226 configured to join with the hinge portion on the flange. The hinged notch may include a width of 5/16". The handle base further includes a grip end 228 for controlling the handle portion. The grip end includes a grip rod 230 that extends out from the flange for gripping and controlling the handle portion. The grip rod may include, without limitation, a torque knob. Those skilled in the art will recognize that the torque knob may exert a positive, repeatable force. The torque knob declutches and turns freely when a desired torque is reached. A handle fastener 232 may extend from an opposite direction of the grip end, passing through the handle aperture to secure the grip end to the flange. In this manner, the base may be secured on one end, and hingedly joined on the other end. In some embodiments, the handle fastener may detach from the handle aperture, whereby the handle portion folds over, and into the inner area of the frame portion. In this manner, the flange may form a flat surface, efficacious for stacking a plurality of reel systems on top of each other. Conversely, the handle portion may pivot back from the inner area, out onto the flange to join the handle fastener with the handle aperture for winding and unwinding operations.

Figure 3A:
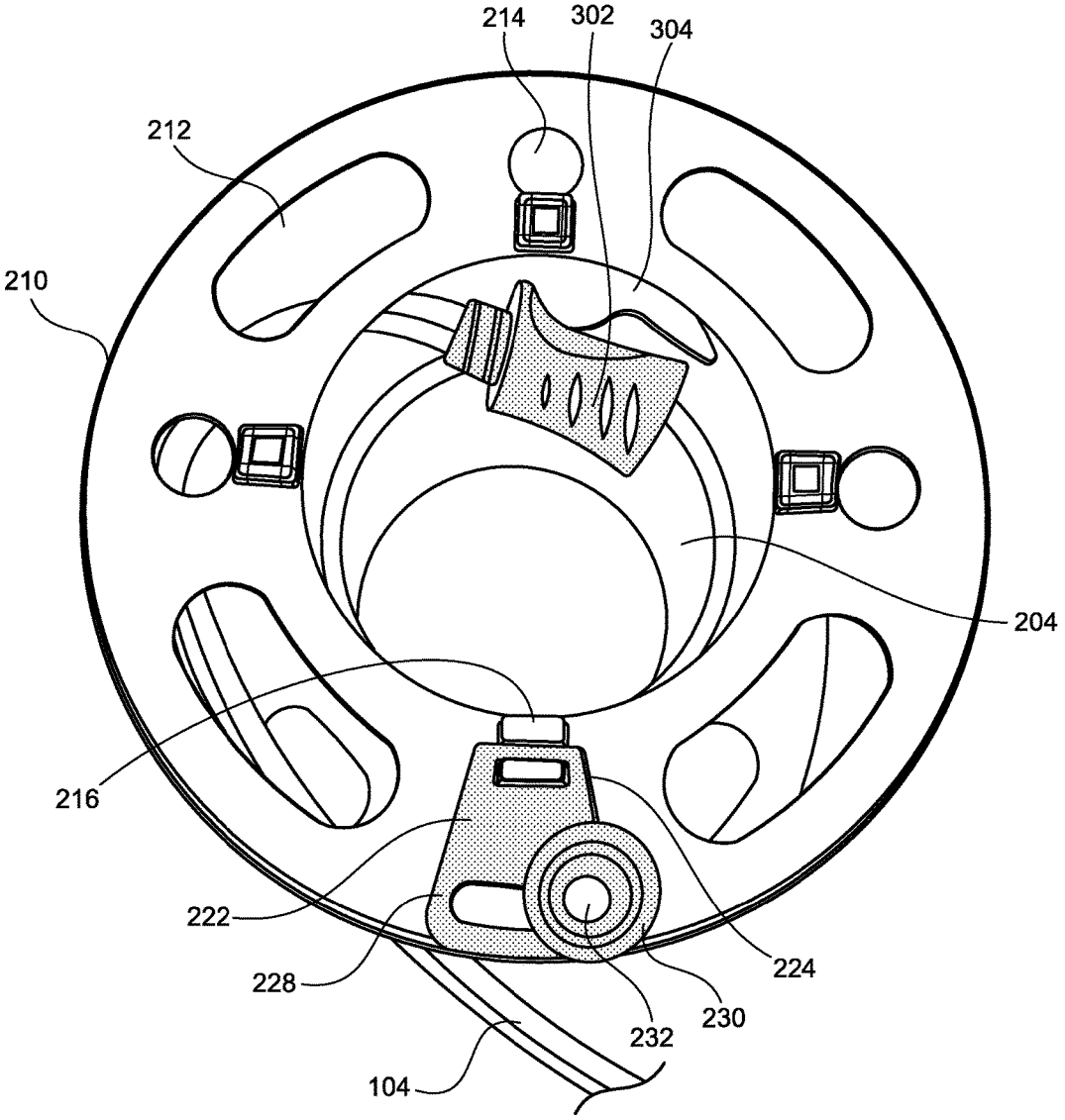
FIGS. 3A, 3B and 3C illustrate detailed perspective views of exemplary reel systems winding an exemplary coilable portion in various stages, in accordance with an embodiment of the present invention.
Figure 3B:
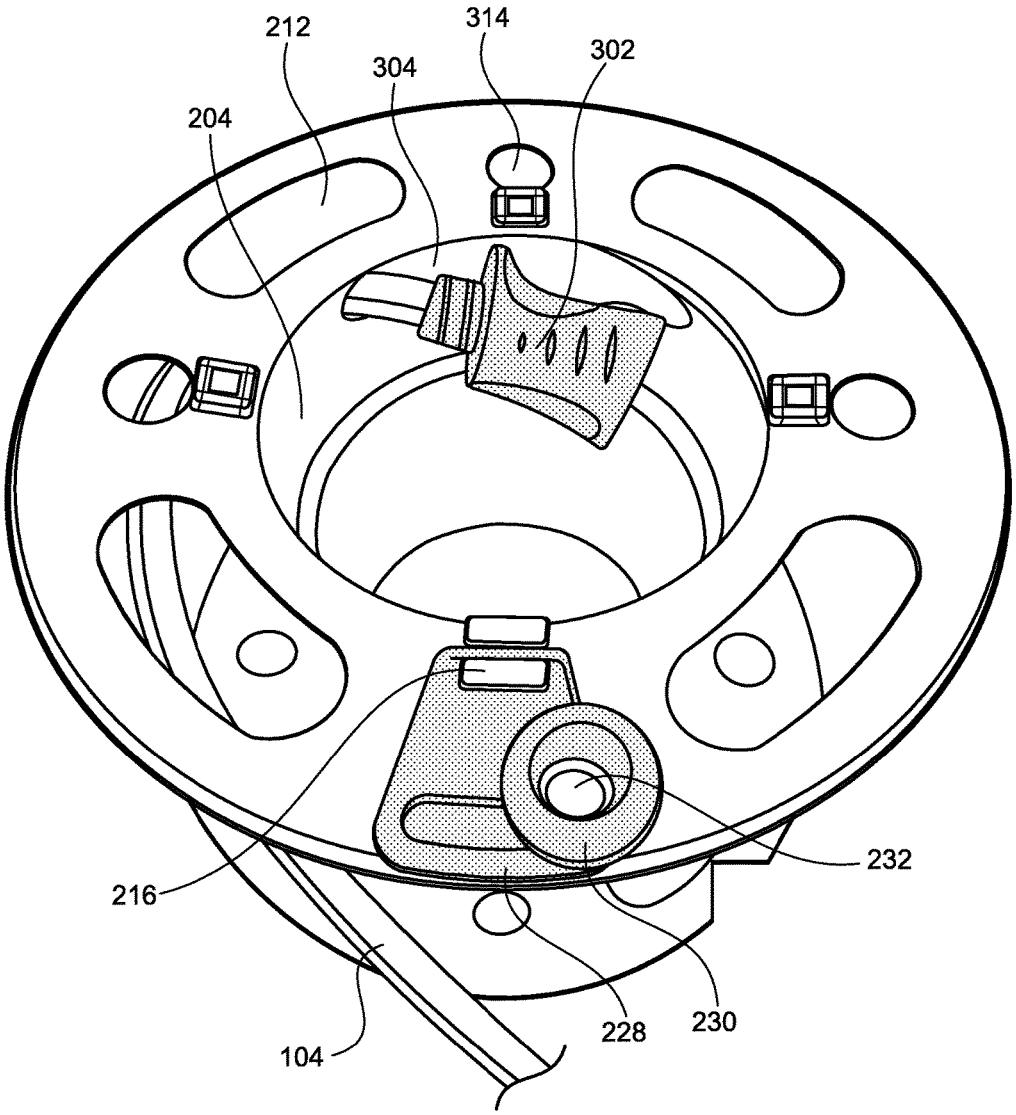
Figure 3C:
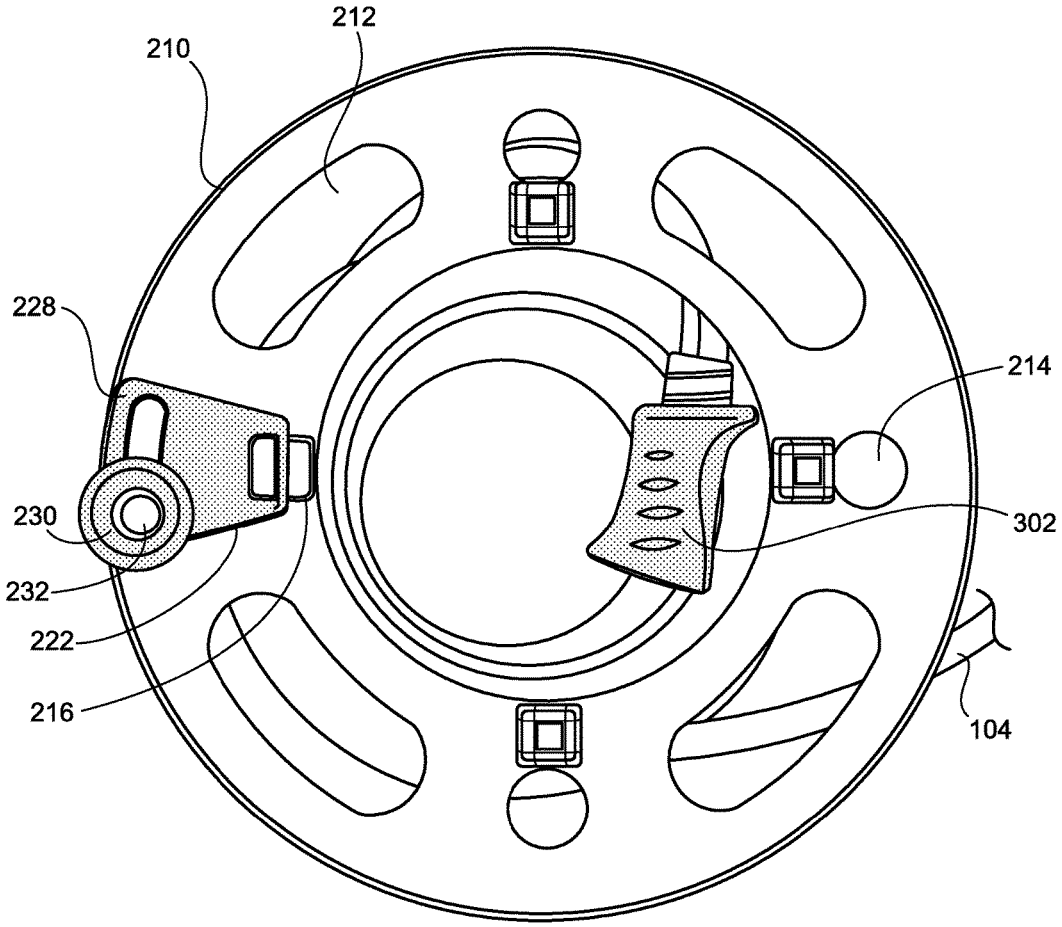

FIGS. 3A, 3B and 3C illustrate detailed perspective views of exemplary reel systems winding an exemplary coilable portion in various stages, in accordance with an embodiment of the present invention. In the present embodiment, the frame portion may further include a frame inner area for receiving and securing a terminal portion 302 of the coilable portion. The terminal portion may at least partially pass from the outer area to the frame inner area through a central aperture 304. The central aperture may provide a sufficiently sized gap for the coiled portion to pass through. The central aperture may also provide a surface for wrapping the coilable portion around for temporary storage.

Figure 4A:
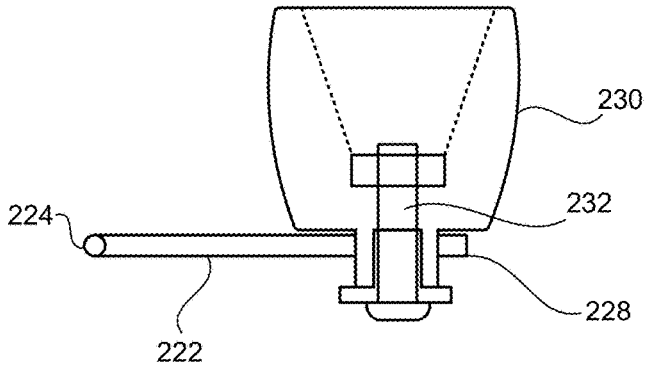
FIGS. 4A, 4B, 4C, 4D, 4E, and 4F illustrate side and top views of exemplary handle portions, where
Figure 4B:
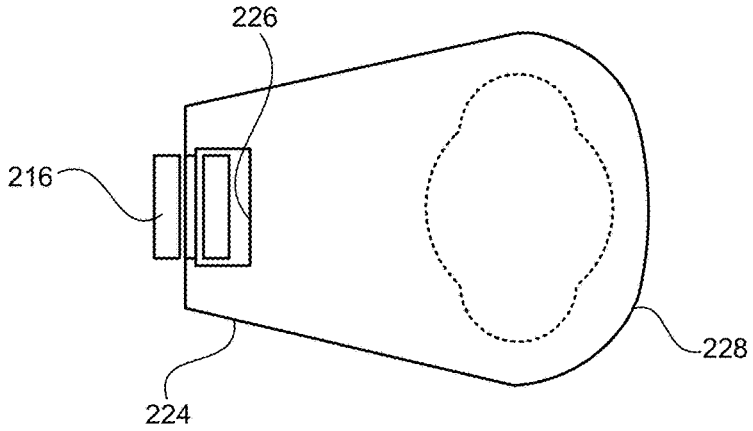
Figure 4C:
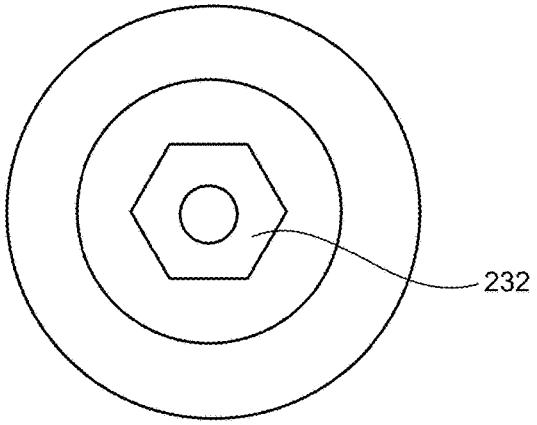
Figure 4D:
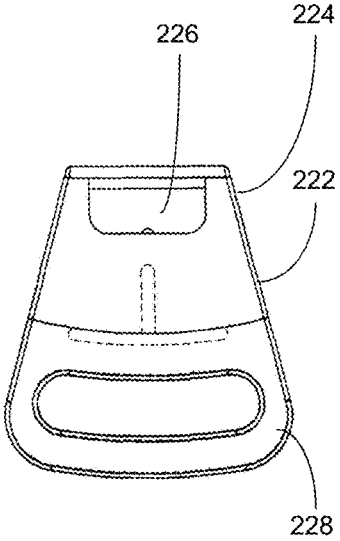
Figure 4E:
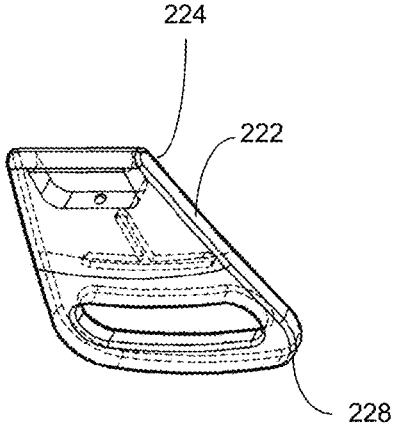
Figure 4F:
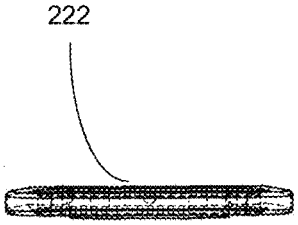

FIGS. 4A, 4B, 4C, 4D, 4E, and 4F illustrate side and top views of exemplary handle portions, where FIG. 4A illustrates an exemplary grip rod secured to an exemplary grip end with a handle fastener, FIG. 4B illustrates a top view of a handle base, FIG. 4C illustrates an top view of an exemplary handle fastener, FIG. 4D illustrates an top view of an exemplary handle fastener, FIG. 4E illustrates a detailed perspective view of an exemplary handle fastener, and FIG. 4F illustrates a side view of an exemplary handle fastener, in accordance with an embodiment of the present invention. In the present embodiment, a handle portion 220 may extend from one of the flanges to provide a grip for rotating the frame portion. The coilable portion may then winds and unwinds around the frame portion. In this manner, cranking the handle portion in a first direction winds the coilable portion into the frame portion, and cranking the handle portion in a second direction unwinds the coilable portion out of the frame portion.

Figure 5A:
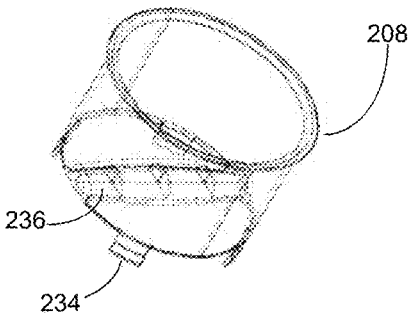
FIGS. 5A, 5B, 5C, 5D, 5E, 5F, 5G, and 5H illustrate various views of exemplary support rod frames, where
Figure 5B:
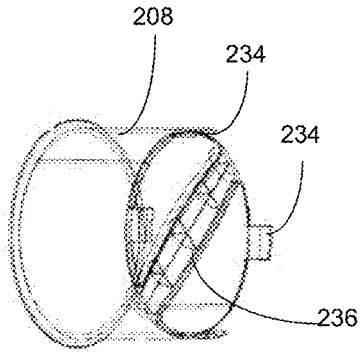
Figure 5C:
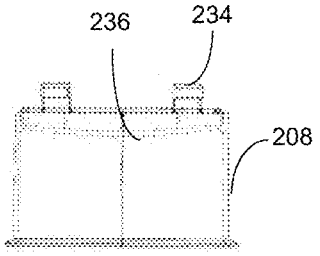
Figure 5D:
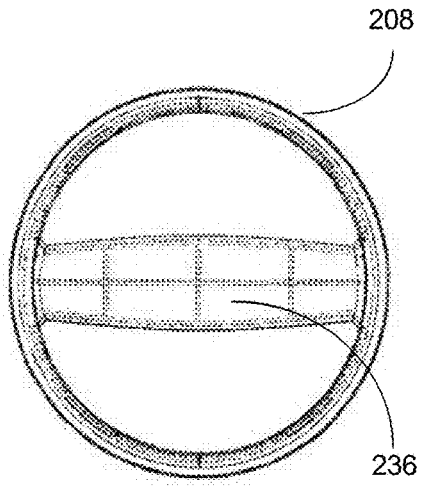
Figure 5E:
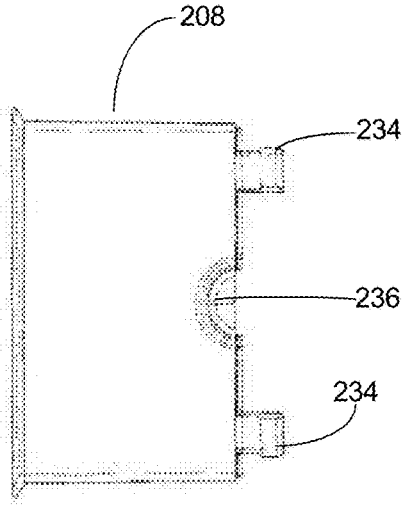
Figure 5F:
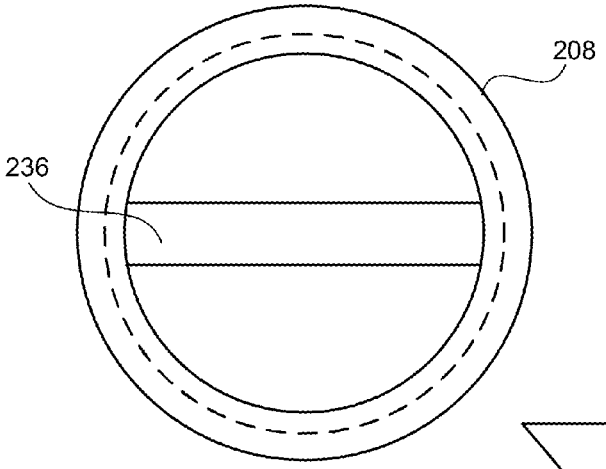
Figure 5G:
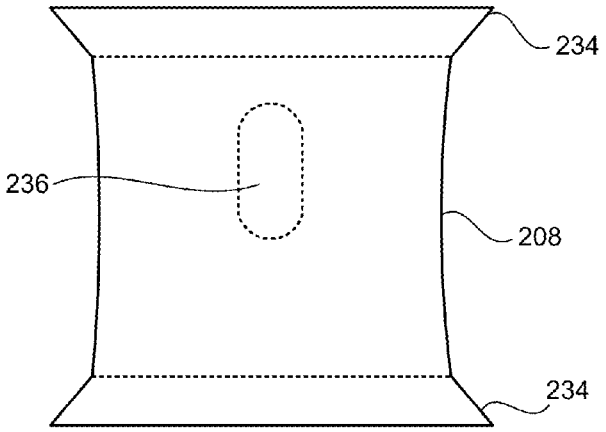
Figure 5H:
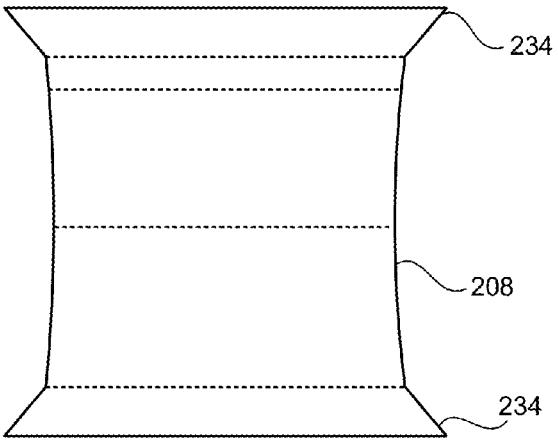

FIGS. 5A, 5B, 5C, 5D, 5E, 5F, 5G, and 5H illustrate various views of exemplary support rod frames, where FIG. 5A illustrates an exemplary detailed perspective view of an exemplary support rod frame with at least one support rod flange, FIG. 5B illustrates an exemplary detailed perspective view of an exemplary support rod frame with at least one support rod flange, FIG. 5C illustrates an exemplary side view of an exemplary support rod frame with at least one support rod flange, FIG. 5D illustrates an exemplary top view of an exemplary support rod frame with at least one support rod flange, FIG. 5E illustrates an exemplary side view of an exemplary support rod frame with at least one support rod flange, FIG. 5F illustrates an exemplary top view of an exemplary support rod frame with at least one support rod flange, FIG. 5G illustrates an exemplary side view of an exemplary support rod frame with at least one support rod flange, and FIG. 5H illustrates an exemplary side view of an exemplary support rod frame with at least one support rod flange, in accordance with an embodiment of the present invention.

In the present embodiment, the frame portion may be sized and dimensioned to fit inside a container, including, without limitation, a five gallon bucket. For example, without limitation, the reel system may include a size of 10"×10"×7". However, in other embodiments, the frame portion and the pair of flanges may include smaller dimensions for storing in a three gallon bucket, a five gallon plastic paint bucket, a five gallon drywall mud bucket, and any nonslender five gallon bucket.

In one alternative embodiment, the reel system may be applied to large hose carriers. In yet another alternative embodiment, the handle portion completely detaches from the flange and reattaches in the frame inner area; thereby forming a smooth flange surface, efficacious for stacking.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of implementing a reel that stacks on flat flange surface according to the present invention will be apparent to those skilled in the art. Various aspects of the invention have been described above by way of illustration, and the specific embodiments disclosed are not intended to limit the invention to the particular forms disclosed. The particular implementation of the reel that stacks on flat flange surface may vary depending upon the particular context or application. By way of example, and not limitation, the reel that stacks on flat flange surface described in the foregoing were principally directed to a handle portion on a reel system that folds over into the frame inner surface implementations; however, similar techniques may instead be applied to a large reel that disperses the coilable portion, such as telephone wire, and oil field hoses so that the large reel stacks on a train bed or a semi-truck bed, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A system comprising:

a frame portion, wherein said frame portion being configured to be operable to rotate on an axis for, at least one of, a winding and an unwinding of a coilable implement, and wherein said frame portion further being configured to store inside a container, said frame portion comprising;

a frame inner surface area, in which said frame inner surface area being configured to at least partially receive a terminal portion of said coilable implement; and a central aperture, in which said central aperture being configured to at least partially allow said terminal portion to pass from a frame outer surface area to said frame inner surface area;

a pair of flanges, wherein said pair of flanges being disposed to join with said frame portion, said pair of flanges comprising;

a plurality of handle apertures; and a plurality of hinges, in which said plurality of hinges being disposed to position adjacent to said plurality of handle apertures;

a handle portion, wherein said handle portion being configured to extend outwardly from said pair of flanges for controlling the, at least one of, winding and unwinding of said coilable implement, and wherein said handle portion further being configured to fold into said frame inner surface area to form a flat surface on said pair of flanges, said handle portion comprising;

a handle base, in which said handle base being disposed to join said pair of flanges;

a grip end, in which said grip end being configured to control said handle portion; and a handle fastener extending from an opposite direction of the grip end, in which said handle fastener being configured to secure said handle portion to at least one of said plurality of handle apertures;

and a support rod frame, wherein said support rod frame being configured to rotate freely within said frame portion, said support rod frame comprising;

at least one support rod flange, in which said at least one support rod flange being configured to join said support rod frame to said frame portion; and a support rod, in which said support rod being disposed to extend across a diameter of said frame inner area.

2. The system of claim 1, in which said storage container comprises at least a five gallon bucket.

3. The system of claim 1, in which said coilable implement comprises, at least one of, a detachable coilable implement and an undetachable coilable implement, and in which said coilable implement further comprises, at least one of, a hose, a cable, a rope, and a Christmas tree light.

4. The system of claim 1, in which said frame portion comprises a circular shaped reel.

5. The system of claim 1, wherein said frame outer surface area is configured to provide a surface for winding and/or unwinding said coilable implement.

6. The system of claim 1, wherein said support rod being configured to provide a grip for transporting an individual frame portion.

7. The system of claim 1, wherein said central aperture is configured to at least form a gap between said frame portion and at least one flange.

8. The system of claim 1, in which said pair of flanges comprises a plurality of slots, said plurality of slots being configured to minimize a weight of said reel system.

9. The system of claim 1, in which said pair of flanges comprises a depression, said depression being configured to provide a space for said terminal portion and/or said coilable implement to at least partially enter said frame inner surface area.

10. The system of claim 1, in which said handle base further being configured to position between one of said plurality of handle apertures and a corresponding one of said plurality of hinges.

11. The system of claim 10, in which said handle base comprises a hinged end, said hinged end being configured to fold said handle portion from said pair of flanges into an inner area of said frame portion.

12. The system of claim 11, in which said hinged end comprises at least a hinge notch, wherein said hinge notch being configured to at least join with said plurality of hinges.

13. The system of claim 1, in which said grip end comprises at least a grip rod, wherein said grip rod being disposed to generally extend from said pair of flanges for gripping said handle portion.

14. The system of claim 13, in which said handle fastener being disposed to join with said grip rod, said handle fastener being configured to at least partially pass through said handle aperture.

15. The system of claim 14, in which said handle fastener comprises at least a pan head screw.

16. The system of claim 1, in which said frame portion and said pair of flanges comprises at least a high density polyethylene.

17. The system of claim 1, in which said frame portion and said pair of flanges comprises a size of 10 inches×10 inches×7 inches.

18. A system consisting essentially of:

a frame portion, said frame portion comprising a reel, said frame portion comprising a high density polyethylene, said frame portion being configured to rotate on an axis for, at least one of, a winding and unwinding of a coilable implement, said frame portion further being configured to store inside a five gallon bucket container, said frame portion comprising a frame inner surface area, said frame inner surface area being configured to at least partially receive a terminal portion of said coilable implement, said frame portion further comprising a central aperture, said central aperture being configured to at least partially allow said terminal portion to pass from a frame outer surface area to said frame inner surface area;

a pair of flanges, said pair of flanges being disposed to join with said frame portion, said pair of flanges further comprising a plurality of handle apertures, said pair of flanges further comprising a plurality of hinges, said plurality of hinges being disposed to position adjacent to said plurality of handle apertures, said pair of flanges comprising a depression, said depression being configured to provide a space for said terminal portion and/or said coilable implement to at least partially enter said frame inner surface area, said pair of flanges comprising a plurality of slots, said plurality of slots being configured to engage said coilable implement;

a handle portion, said handle portion being configured to extend outwardly from said pair of flanges for controlling the, at least one of, winding and unwinding of said coilable implement, said handle portion further being configured to fold into an inner area of said frame portion to form a flat surface on said pair of flanges for stacking a plurality of systems in said container, said handle portion comprising a handle base, said handle base being disposed to join said pair of flanges, said handle base further being configured to position between said plurality of handle apertures and said plurality of hinges, said handle base comprising a hinged end, said hinged end being configured to fold said handle portion from said pair of flanges into said inner area of said frame portion, said hinged end comprising a hinge notch, said hinge notch being configured to join with said plurality of hinges, said handle base comprising a grip end, said grip end being configured to control said handle portion; and a support rod frame, said support rod frame being configured to rotate freely within said frame portion, said support rod frame being disposed to position inside said frame portion, said support rod frame comprising at least one support rod flange, said at least one support rod flange being configured to join said support rod frame to said frame portion, said support rod frame further comprising a support rod, said support rod being disposed to extend across a diameter of said inner area of said frame portion, said support rod being configured to provide a grip for transporting said frame portion.

* * * * *